US011506199B2

(12) United States Patent
Laperriere et al.

(10) Patent No.: US 11,506,199 B2
(45) Date of Patent: Nov. 22, 2022

(54) PUMP ASSEMBLY WITH PUMP CHAMBERS LOCATED RADIALLY RELATIVE TO ONE ANOTHER AND CONNECTED SERIALLY

(71) Applicant: PRATT & WHITNEY CANADA CORP., Longueuil (CA)

(72) Inventors: Claude Laperriere, Longueuil (CA); Stephane Prunera-Usach, Montreal (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 168 days.

(21) Appl. No.: 16/784,502

(22) Filed: Feb. 7, 2020

(65) Prior Publication Data

US 2021/0246898 A1 Aug. 12, 2021

(51) Int. Cl.

| | |
|---|---|
| ***F04C 11/00*** | (2006.01) |
| ***F04C 15/00*** | (2006.01) |
| ***F04C 2/18*** | (2006.01) |

(52) U.S. Cl.

CPC ..... *F04C 11/001* (2013.01); *F04C 2/18* (2013.01); *F04C 15/0061* (2013.01)

(58) Field of Classification Search

CPC ..... F04C 11/001; F04C 15/0061; F04C 2/18
See application file for complete search history.

(56) References Cited

U.S. PATENT DOCUMENTS

| | | | | |
|---|---|---|---|---|
| 2,185,338 | A * | 1/1940 | Hassler | F04C 23/001 417/428 |
| 2,575,154 | A * | 11/1951 | Zoll | F04C 11/001 418/199 |
| 6,048,186 | A * | 4/2000 | Kitano | G01F 3/10 73/261 |
| 8,128,377 | B2 | 3/2012 | Earhart et al. | |
| 8,342,829 | B2 * | 1/2013 | Achtelik | F04C 23/001 418/201.1 |
| 8,807,972 | B2 | 8/2014 | Reighard et al. | |
| 9,945,376 | B2 | 4/2018 | Ribarov et al. | |
| 9,976,483 | B2 | 5/2018 | Venter | |

(Continued)

FOREIGN PATENT DOCUMENTS

EP 736691 A1 10/1996

*Primary Examiner* — Mary Davis
(74) *Attorney, Agent, or Firm* — Norton Rose Fulbright Canada LLP

(57) ABSTRACT

A pump assembly comprising a casing having a first pump chamber defining a first flow path and a second pump chamber or more defining a second flow path. A first pump stage includes a first shaft mounted to the casing for rotation about a rotation axis, a first pair of intermeshing gears disposed in the first flow path of the first pump chamber, the first pair of intermeshing gears interfacing each other in operative engagement, one intermeshing gear of the first pump stage mounted on the first shaft. A second pump stage includes a second shaft mounted to the casing for rotation about a rotation axis different than the rotation axis of the first shaft, a second pair of intermeshing gears disposed in the second flow path of the at least second pump chamber, the second pair of intermeshing gears interfacing each other in operative engagement, one intermeshing gear of the second pump stage mounted on the second shaft. A transmission drivingly engages the first shaft to the second shaft.

10 Claims, 5 Drawing Sheets

(56) References Cited

U.S. PATENT DOCUMENTS

| | | | | |
|---|---|---|---|---|
| 2005/0185043 | A1* | 8/2005 | Kim | F04C 11/001 347/141 |
| 2005/0191186 | A1 | 9/2005 | Harris et al. | |
| 2006/0257267 | A1* | 11/2006 | Weiss | F04C 11/005 417/199.1 |
| 2019/0055854 | A1 | 2/2019 | Chenoux et al. | |
| 2019/0170294 | A1 | 6/2019 | Wilson et al. | |

* cited by examiner

PUMP ASSEMBLY WITH PUMP CHAMBERS LOCATED RADIALLY RELATIVE TO ONE ANOTHER AND CONNECTED SERIALLY

TECHNICAL FIELD

The application relates generally to pumps and, more particularly, to multi-stage pumps for aircraft engines.

BACKGROUND OF THE ART

Aircraft engines, such as gas turbine engines or jet engines, typically include one or more pumps. Such pumps can be used for pumping oil to operate machinery implements, supplying oil to turbine engine systems, for pumping an air/oil mixture from an oil sump from a jet engine or from an airframe or engine mounted gearboxes, for instance. Various engines configurations may provide limited space for such pumps, and/or the sizes or dimensions for some pump configurations, like multi-stage pumps, may limit engine design possibilities.

SUMMARY

In one aspect, there is provided a pump assembly having at least two pump stages operatively engaged to each other via a transmission. In one variant of the pump assembly, the transmission may be coupled to respective shafts of the at least two pump stages to transmit torque from one pump stage to the other.

In another aspect, there is provided a pump assembly comprising: at least one casing having a first pump chamber defining a first flow path and at least a second pump chamber defining a second flow path; a first pump stage including a first shaft mounted to the casing for rotation about a rotation axis, a first pair of intermeshing gears disposed in the first flow path of the first pump chamber, the first pair of intermeshing gears interfacing each other in operative engagement, one intermeshing gear of the first pump stage mounted on the first shaft; at least a second pump stage including a second shaft mounted to the casing for rotation about a rotation axis different than the rotation axis of the first shaft, a second pair of intermeshing gears disposed in the second flow path of the at least second pump chamber, the second pair of intermeshing gears interfacing each other in operative engagement, one intermeshing gear of the second pump stage mounted on the second shaft; and a transmission drivingly engaging the first shaft to the second shaft.

In a further aspect, there is provided a pump assembly for an aircraft engine, comprising a casing enclosing at least a first and a second pump stages, the at least first and second pump stages including respective pairs of intermeshing rotating components disposed in respective pump chambers of the casing, the pairs of rotating components mounted for rotation relative to the casing via at least one shaft of the first pump stage and at least one shaft of the second pump stage, a transmission drivingly engaging the pairs of rotating components of the first and second pump stages by coupling to the at least one shaft of the first pump stage and the at least one shaft of the second pump stage.

In a further aspect, there is provided a gear pump assembly comprising: a housing defining a first pump chamber and at least a second pump chamber, the first and second pump chambers forming respective first and second fluid paths; a first pump stage including a first pair of intermeshing gears in fluid-structure interaction with the first fluid path and mounted into the first pump chamber for rotation about respective rotation axes via a first shaft and a second shaft mounted to the housing; at least a second pump stage including a second pair of intermeshing gears in fluid-structure interaction with the second fluid path and mounted into the second pump chamber for rotation about respective rotation axes via a third and a fourth shafts mounted to the housing, the rotation axes of the first and the second pair of intermeshing gears radially spaced apart with respect to each other; a transmission drivingly engaging one of the first and second shafts to one of the third and fourth shafts, and a power input gear mounted on one of the first, second, third and fourth shafts, the power input gear operatively engageable to a power source to transmit torque to the first pump stage and at least the second pump stage.

DESCRIPTION OF THE DRAWINGS

Reference is now made to the accompanying figures in which.

DETAILED DESCRIPTION

Figure 1:
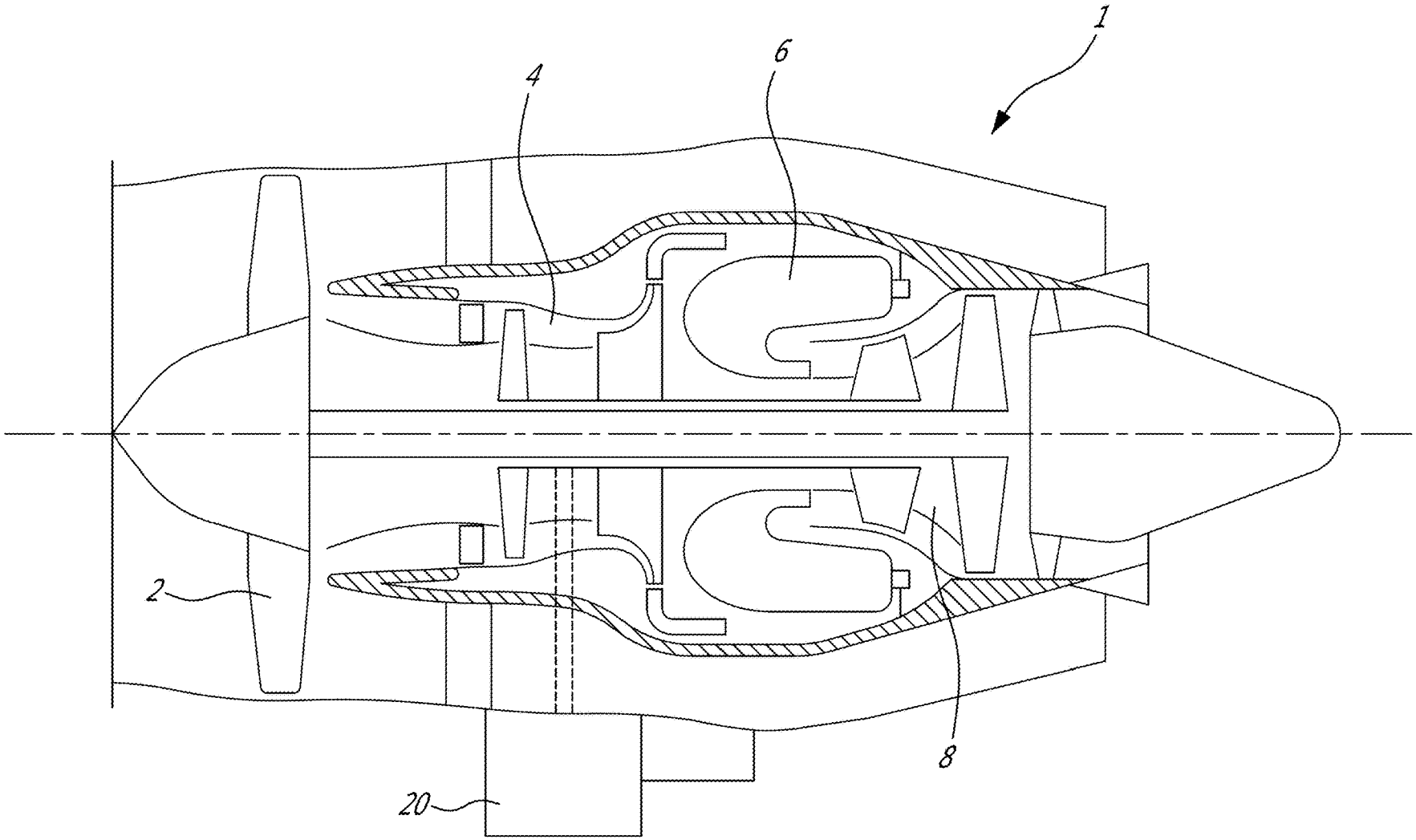
FIG. 1 is a schematic cross-sectional view of a gas turbine engine.

FIG. 1 illustrates a gas turbine engine 1 of a type preferably provided for use in subsonic flight, generally comprising in serial flow communication a fan 2 through which ambient air is propelled, a compressor section 4 for pressurizing the air, a combustor 6 in which the compressed air is mixed with fuel and ignited for generating an annular stream of hot combustion gases, and a turbine section 8 for extracting energy from the combustion gases.

Aircraft engines, including the type of engine shown in FIG. 1, typically have one or more pumps to perform different pumping functions. As an example, one or more pumps may be used to discharge or scavenge oil (oil, air/oil mixture or other fluids) to/from one or more engine components. Aircraft engines may have a single pump (or pump assembly) to limit the space (volume) of the aircraft engines dedicated to such component. Such pump(s) may include multiple pump stages to feed and/or scavenge fluid to/from different areas in the aircraft engine.

Figure 2:
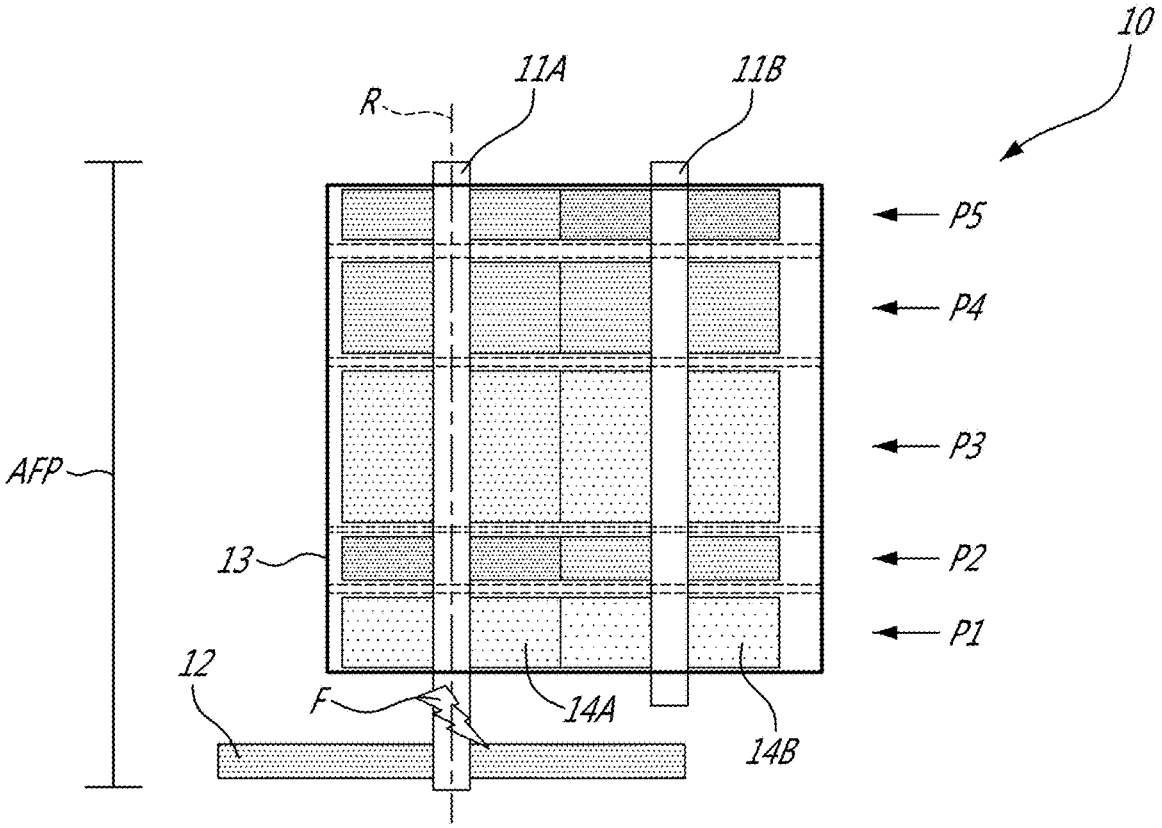
FIG. 2 is a schematic cross-sectional view of a pump assembly, taken along a rotational axis R thereof.
Figure 3:
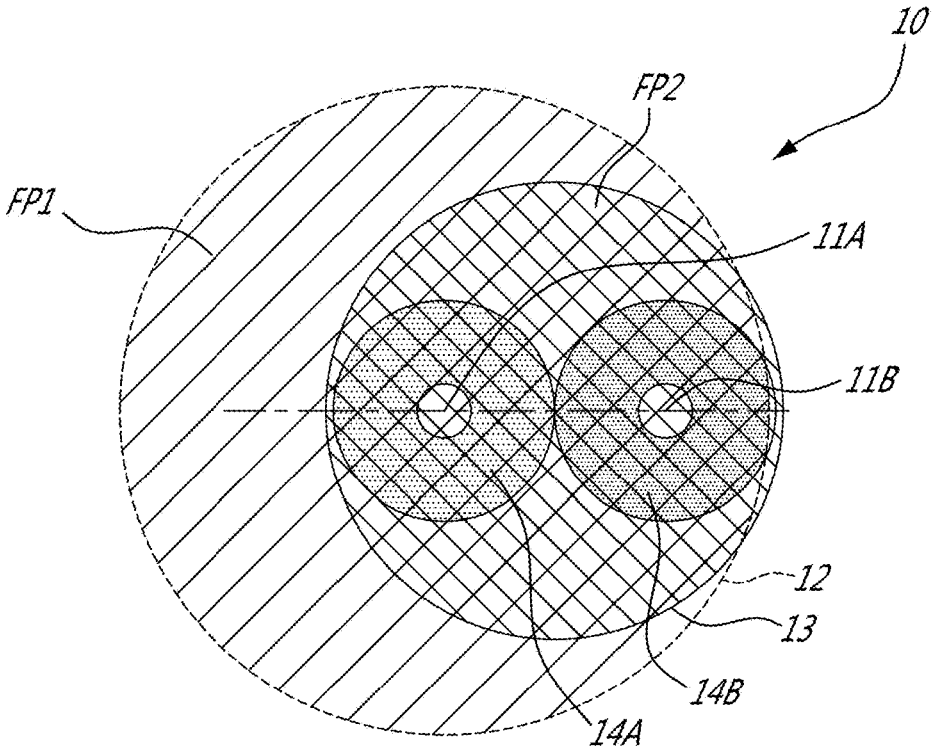
FIG. 3 is a schematic radial cross-sectional view of the pump assembly of FIG. 2, normal to the rotational axis R thereof.

Referring to FIGS. 2-3, an exemplary pump 10 (or pump assembly 10) is shown. As shown in FIG. 2, a number of pump stages P1 to P5 may be stacked axially along shafts 11A and 11B, thereby forming an axial pump architecture. All of the pump stages P1 to P5 are stacked axially along rotation axis R of the common shaft 11A. The pump stages P1 to P5 each have pairs of rotating elements 14A, 14B mounted respectively on shafts 11A and 11B. A pair of said rotating elements 14A, 14B, which may be toothed gears, located in the pumped fluid displace a volume of fluid during joint rotation thereby creating pumping action. The rotating elements 14A, 14B intermesh together such that one rotating element 14A may impart rotation (or transmit torque) to the other rotating element 14B by mutual engagement. While FIGS. 2-3 do not show detail on intermeshing rotating elements 14A, 14B, suffice it to say with respect to FIGS. 2-3 that the rotating elements 14A, 14B can transmit load to each other via their mutual mechanical engagement.

In FIG. 2, the pump stages P1 to P5 are driven by the common shaft 11A. The common shaft 11A is driven by a power input gear 12, or other transmission component. As shown in FIG. 2, the power input gear 12 is mounted on the common shaft 11A. The power input gear 12 has a radial footprint FP1 (or visible frontal area) that is greater than the radial footprint FP2, (or visible frontal area) of the casing 13. In FIG. 3, casing 13 is schematically shown as having a visible frontal shape of a disc enclosing the pump stages P1 to P5 in FIG. 3 for simplicity, though practical implementations of the casing 13 may have other (more complex) visible frontal shape. The power input gear 12 is typically coupled to a power source (not shown) external to the pump assembly 10 that supplies a workload to the pump assembly 10 during operation. Any suitable power source such as those used in aircraft engines to supply power to pumps may be used and will not be detailed herein.

As shown, the power input gear 12 transmits workload from the power source to the pump stages P1 to P5. The pump stages P1 to P5 of the pump assembly 10 are all driven by workload transmitted by the power input gear 12 via the common shaft 11A, which has one of the rotating elements 14 of each pump stage P1 to P5 mounted thereto. Torque may be transferred from that rotating element 14 mounted on shaft 11A to the other rotating element 14 mounted on shaft 11B. In this case, the power input gear 12 is the only power input of the pump assembly 10 that provides power to the pump stages P1 to P5. A fuse F (e.g. mechanical or electrical fuse or switch) is located at the power input of the pump assembly 10. In case of emergency or other situations requiring sudden stop of the pump assembly 10, the fuse F may break, disengage or otherwise cut off the power supplied to the pump assembly 10. The pump assembly 10 configured with a fuse F (or other types of safety system) may be desirable in situations where, for instance, scavenge pump(s) (or scavenge pump stages of the pump assembly 10) fail(s) thus requiring the shutdown of pressure pump(s) to avoid or limit adverse effects of the absence or lack of lubricating fluid or lubricating fluid overflow in engine components fluidly supplied by the pump assembly 10.

An axial pump architecture, such as the example of pump assembly 10 shown in FIGS. 2-3 with all its pump stages P1 to P5 stacked axially as described above may limit axial compactness of a pump assembly. The axial foot print AFP of such pump assembly 10 may increase proportionally to the number of axial pump stages. Limiting the axial foot print AFP of a multi-stage pump may be desirable, for instance in compact engine configurations, without limiting the multi-stage pump performance and/or number of stages.

A pump assembly 20 is described herein with reference to various embodiments. The pump assembly 20 defines two or more pump stages operatively engaged to each other via a transmission. In an embodiment, the transmission is drivingly engaged to respective shafts (e.g. by direct coupling or indirect coupling via an intermediary piece or component) of distinct pump stages to transmit torque from one pump stage to the other.

Figure 4:
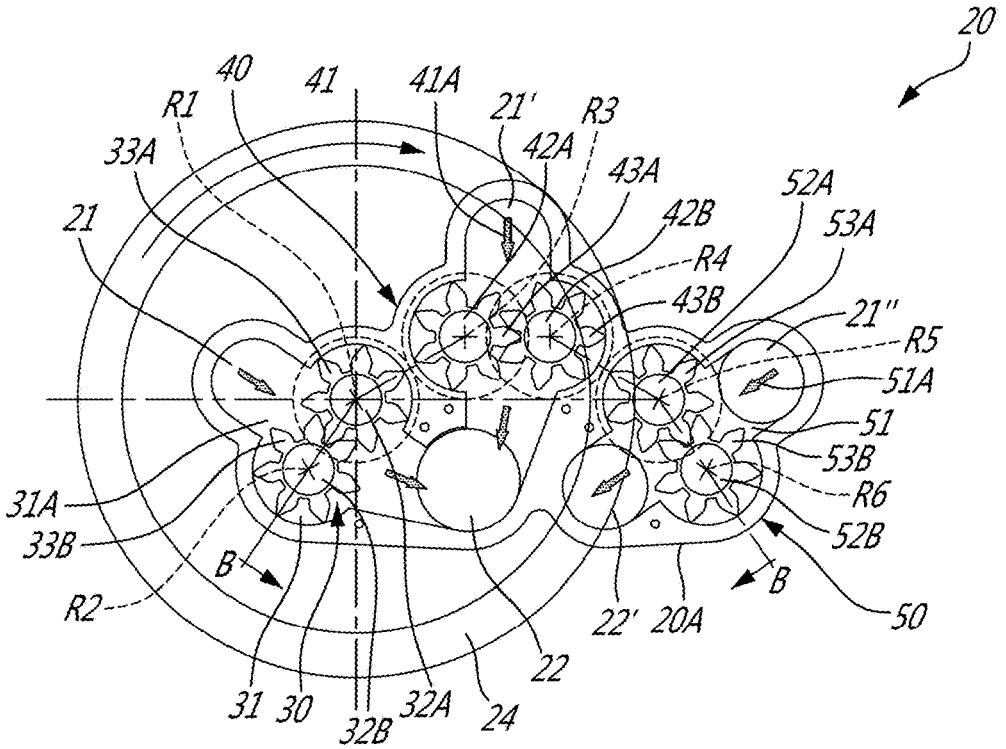
FIG. 4 is a schematic radial cross-sectional view of another exemplary pump assembly, taken normal to a rotational axis R1 thereof.
Figure 5:
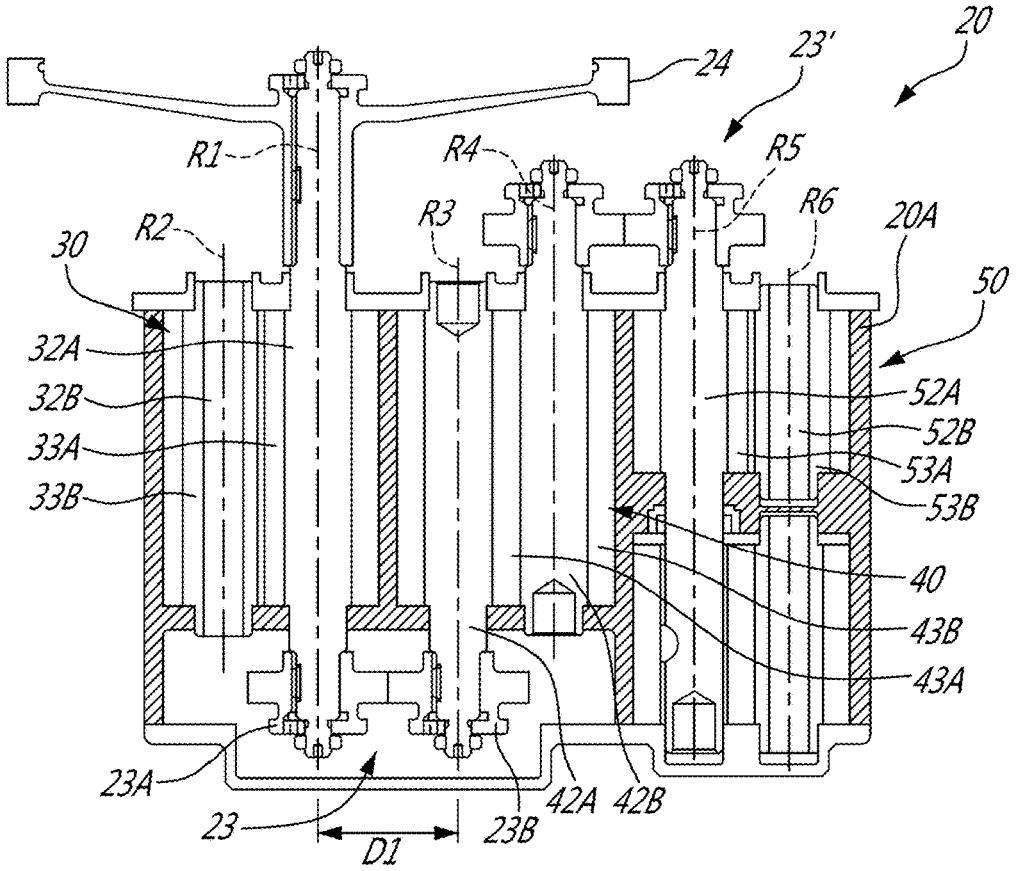
FIG. 5 is a schematic cross-sectional view of the pump assembly of FIG. 4, taken along plane B-B of FIG. 4.

Referring to FIGS. 4-5, the pump assembly 20 comprises a casing 20A (casing or "housing") enclosing a plurality of pump stages 30, 40, 50. In operation, the pump assembly 20 builds and/or maintains a fluid flow between inlet(s) and outlet(s) whereby fluid is supplied in the casing 20A and discharged from the casing 20A respectively. The casing 20A defines one pump chamber per pump stage 30, 40, 50 in fluid communication with at least one inlet port 21 and at least one outlet port 22. Depending on the embodiment, the pump chambers (all or selected ones of them) may be in fluid communication with each other, via one or both of inlet port 21 and outlet port 22. In an embodiment, the pump assembly 20 with multi stages can have more than one casing 20A. For example, the pump stages 30 and 40 may be in a first casing 20A, and the pump stage 50 may be another casing 20A, etc.

The pump assembly 20 comprises a transmission 23 operatively engaging two (or more) of the pump stages 30, 40, 50. Depending on the embodiment, the transmission 23 may be configured to cause different rotational speeds in one pump stage 30 relative to another pump stage 40 drivingly engaged via the transmission 23. This may be done by having different gear ratios or transmission ratios within the transmission 23. This may allow tuning of the speed of the pump stages based on operating parameters of the engine 1 and/or engine 1 requirements, and/or allow more flexibility as to the geometry of the pump assembly 20 adapted for compact engine designs. In the depicted embodiment, the transmission 23 is one of a plurality of transmissions, with a second transmission 23' drivingly engaging the second pump stage 40 and the third pump stage 50 to each other.

In some embodiments, such as shown in FIG. 5, the transmission(s) 23, 23' may include a plurality of transmission gears, with at least one of the plurality of gears mounted on each one of a shaft of the first pump stage 30 and a shaft of the second pump stage 40, as described below. In the depicted embodiment, the transmission 23 includes a set (two in this particular case) of transmission gears 23A, 23B mechanically connected (or intermeshing) to one another for engaging reciprocally respective ones of their gear teeth. Other configurations of transmissions may be contemplated in other embodiments. For instance, although not shown, the transmission 23 may include a chain interconnecting gears mounted on respective shafts of the first and second pump stages 30, 40. Such types of transmission 23 may be referred to as a "direct drive" transmission, in that the transmission may directly transmit torque between a power input and a workload (or from a first workload to a second workload, depending on the configuration). Pulleys and belts may be viewed as workable components of a transmission 23 as well.

In the depicted embodiment, the transmission gears 23A, 23B are shown as spur gears, but other geometries may be contemplated. For instance, conical gears of a transmission 23 may allow angular relative disposition of the shaft(s) of the drivingly engaged pump stages (e.g. 30, 40). That is, although not shown, a pump stage may include one or more shaft(s) extending angularly with respect to one or more shaft(s) of an adjacent pump stage. Such pump stages may be operatively engaged to each other via intermeshing conical gears and mounted respectively on a shaft of a first pump stage and a shaft of the second pump stage. The pump stages may thus be disposed at an angle with respect to each other, and operatively engaged via such transmission 23. The relative angle between the pump stages could vary depending on the embodiments and/or available space to fit the pump assembly 20 within the aircraft engine envelope, for instance.

The depicted pump assembly 20 may have a power input gear 24. The power input gear 24 may be coupled to any suitable power source for operation of the pump assembly 20, although not shown. The power input gear 24 in this embodiment is disposed at an axial end of the pump assembly 20 opposite the axial end of the pump assembly 20 at which the transmission 23 drivingly engaging the first and second pump stages 30, 40 is located. This may be different in other embodiments. As in the depicted embodiment of FIGS. 6-7, the power input gear 24 may be located at the same axial end of the pump assembly 20 as the transmission 23. In some embodiments, such as in FIGS. 6-7, the power input gear 24 may be part of the transmission 23. For instance, the power input gear 24 may be connected to one transmission component, such as transmission gear 23A, whether integrally connected therewith or not. In an embodiment, the transmission 23 may include transmission gears 23A, 23B (e.g. toothed gears) drivingly engaged to each other to transmit torque from one shaft to another shaft, with the power input gear 24 and one of the transmission gears 23A, 23B both mounted on a same shaft. In other embodiments the power input gear 24 may not share (e.g. be mounted on) the same shaft as components of the transmission 23.

Figure 6:
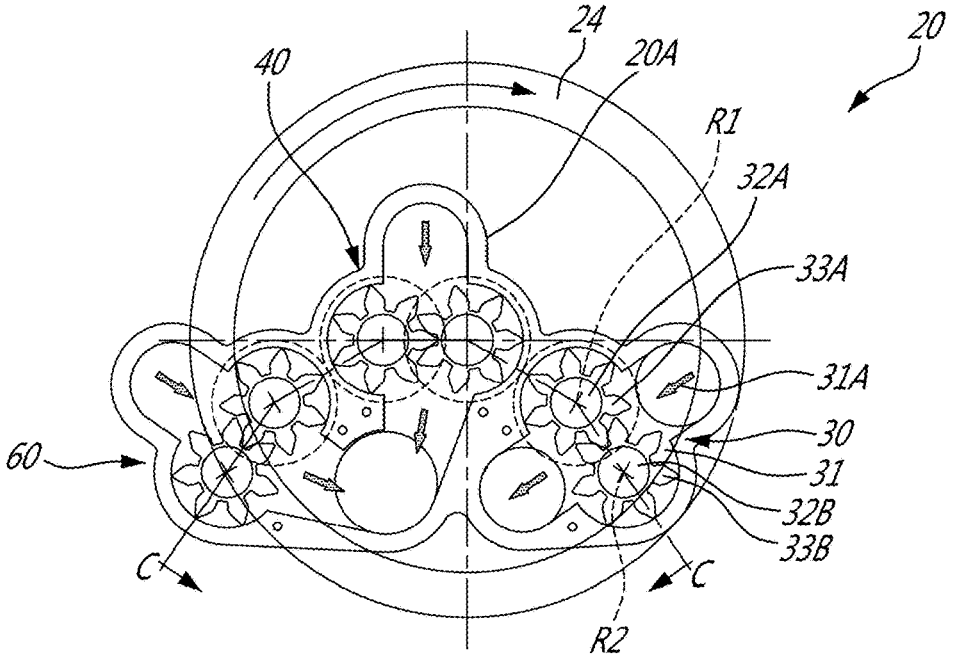
FIG. 6 is a schematic radial cross-sectional view of another embodiment of the pump assembly of FIGS. 4-5, taken normal to a rotational axis R1 thereof.
Figure 7:
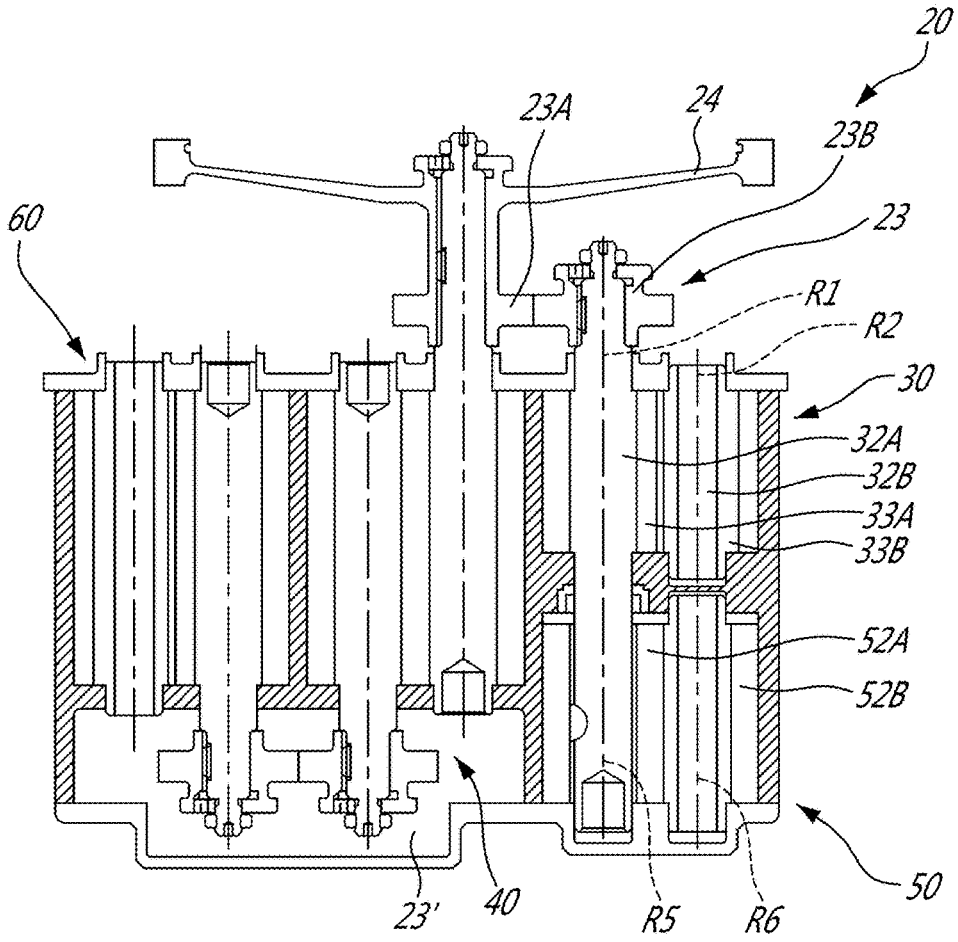
FIG. 7 is a schematic cross-sectional view of the pump assembly of FIG. 6, taken along plane C-C of FIG. 6.

Returning to FIGS. 4-5, in the depicted embodiment, the power input gear 24 is mounted on a shaft of the first pump stage 30. As such, the shaft with the power input gear 24 may be referred to as a drive shaft of the pump assembly 20, such drive shaft configured to receive workload from a power source external to the pump assembly 2. Such workload received on the drive shaft is shared between the pump stages via the transmission 23, as described later. The power input gear 24 may be connected to shafts of the other stages instead of being connected to the first stage 30. In other words, the power input gear 24 may be mounted on a different shaft of the pump assembly 20 than shown in FIGS. 4-5, such that the relative position of the power input gear 24 and the remainder of the body of the pump assembly 20 may differ depending on the embodiments. This is illustrated in FIGS. 6-7 and described later as an example.

Although not shown, the embodiment of the pump assembly 20 shown in FIGS. 4-5 may have a safety system, such as discussed earlier and exemplified as fuse F in the figures, at the power input of the pump assembly 20.

Although part of the same pump assembly 20, the pump stages 30, 40, 50 may be associated to different functions, such as scavenge stage or pressure stage. A scavenge pump (or pump stage) receives used fluid from a component of the aircraft engine 1 (e.g. from a gearbox, or other components with lubrication, for instance), whereas a pressure pump (or pump stage) discharges fluid received from a fluid source (e.g. fluid reservoir) toward a component of the aircraft engine 1 that requires fluid to function (e.g. lubrication). For instance, in an embodiment a first pump stage 30 may be a pressure pump stage and a second pump stage 40 may be a scavenge pump stage. In some embodiments, the pressure pump stage may be operable to circulate fluid from one (e.g. a first) inlet port 21 to one outlet port 22 of the pump assembly 20 to a component of the aircraft engine 1. The scavenge pump stage may be operable to circulate fluid from another inlet port 21' distinct from the inlet port 21 of the pressure pump stage, where such other inlet port 21' may receive fluid from the same (or another) component of the aircraft engine 1. The scavenge pump stage may discharge fluid to another outlet port 22' distinct from the outlet port 22 of the pressure pump stage.

Features of a first pump stage 30 will now be described. Corresponding (and/or similar) features of the other pump stages 40, 50 will be referred to later.

In the depicted embodiment, the pump chamber 31 of the first pump stage 30 defines a first flow path 31A. In the depicted embodiment, the first pump stage 30 includes shafts 32A, 32B mounted to the casing 20A for rotation about respective rotation axes R1, R2, with a pair of intermeshing gears 33A, 33B disposed in the flow path 31A of the first pump chamber 31. The intermeshing gears 33A, 33B define the rotating elements moving the volume of fluid within the pump chamber 31 to give motive flow to the fluid. During rotation, the intermeshing gears 33A, 33B in the fluid in the pump chamber 31 induces fluid circulation in the flow path 31A. Such pair of intermeshing gears 33A, 33B intermesh each other for reciprocal rotation. One intermeshing gear 33A of the first pump stage 30 is mounted on the first shaft 32A rotating about rotation axis R1 and may be regarded as a drive gear to impart rotation to the other gear 33B. Pump stages with such shafts and gears arrangement may be referred to as gear (or external gear) pumps (or stages of a gear pump).

Figure 8:
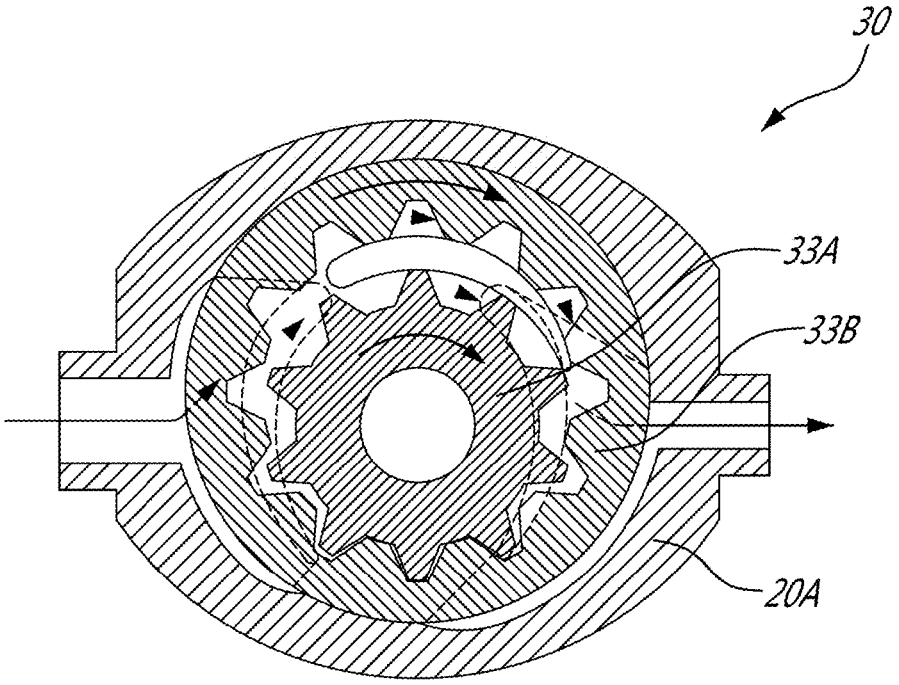
FIG. 8 is a schematic representation of an exemplary gerotor pump stage as a variant of pump stage(s) of the pump assembly of FIGS. 4-7.

Other types of pump arrangement may be contemplated in other embodiments. For instance, as shown in FIG. 8, pair of intermeshing gears 33A, 33B may be in an eccentric arrangement, and include a driving gear 33A and a driven gear 33B. The driven gear 33B has an annular shape, shown in FIG. 8 with internal teeth to drivingly engage external teeth of the driving gear 33A disposed in the driven gear 33B. As such, the pump stage 30 may include only one shaft 32A supporting both gears 33A, 33B, with the driving gear 33A mounted on said shaft 32A. Such type of pumps may be referred to as a gerotor pump. The pump stages may (or may not) have the same configuration (or "type") of pump depending on the embodiments. Other types of pumps or pump stages may be contemplated, although less desirable in the context of aircraft engines.

Returning to FIGS. 4-5, the second pump stage 40 has a similar features as the pump stage 30 previously described. The pump chamber 41 defines a second flow path 41A. In the depicted embodiment, the flow paths 31A and 41A extend from distinct fluid inlet ports 21, 21' to a common fluid outlet port 22 of the pump assembly 20. In the depicted embodiment, the second pump stage 40 includes shafts 42A, 42B mounted to the casing 20A for rotation about respective rotation axes R3, R4, with a pair of intermeshing gears 43A, 43B disposed in the flow path 41A of the second pump chamber 41. The shaft 42A is rotatably supported relative to the casing 23 for rotation about a rotation axis R3 different than the rotation axis R1 of the shaft 32A of the first stage 30. The intermeshing gears 42A, 42B of the second stage 40 intermesh each other for joint rotation. One intermeshing gear 42A of the second pump stage 40 is mounted on the shaft 42A. The other intermeshing gear 42B of the second pump stage 40 is mounted on shaft 42B.

In the depicted embodiment, shafts 32A, 42A extend parallel to each other, though this is optional. The shafts 32A, 42A extend along respective rotation axes R1 and R3, with their rotation axes being parallel to each other. The shafts 32A, 42A are radially spaced apart from each other by a distance D1 (see FIG. 5), when viewed in a cross-sectional plane transverse to their rotation axes R1, R3, such as plane B-B of FIG. 5. The rotation axes R1, R3 of the respective shafts 32A, 42A are thus radially spaced apart from each other.

In the depicted embodiment, the transmission 23 drivingly engages shaft 32A in the first stage 30 and shaft 42A in the second pump stage 40. In other words, the transmission 23 forms a mechanical link between the shaft 32A of the first pump stage 30 and the shaft 42A of the second pump stage 40. The transmission 23 may therefore transmit torque from one shaft 32A to the other shaft 42A. Having a transmission 23 operatively engaging the pump stages 30, 40 may allow the pump stages 30 and 40 to be side by side as opposed to being axially stacks, which may result in a reduced axial footprint AFP of the pump assembly 20 in comparison to a pump assembly having a same number of stages but arranged in an axial stack. The transmission 23 may thus allow a radial disposition of the pump stages with respect to each other instead of an axial disposition along one shaft of the pump assembly 20, as shown in FIGS. 2-3. In other words, pump stages 30, 40 may be disposed parallel (or in a side-by-side relationship) when viewed in a radial cross-sectional plane of the pump assembly 20, as in FIG. 4. This may result in a more axially compact pump assembly 20, and/or limit the length of the pump assembly 20, for instance to meet engine design needs. While a radial footprint of the pump assembly 20, including the radial footprint FP2 of the pump stages may increase over that of a pump assembly 20 with multiple pump stages stacked axially, such as shown in FIGS. 2-3, it may be more desirable to limit the axial footprint AFP (i.e. be more "axially compact") of the pump assembly 20 than to limit its radial footprint. The expression "radial" footprint is used as a rotational axis R1 of the drive shaft 32A is normal to the footprint. For instance, even if the radial footprint of the pump assembly 20 is increased, the radial footprint FP1 of the power input gear 24, which on FIG. 4 would correspond to the radial space occupied by part 24, may be greater than the radial footprint FP2 of the casing 20A, which would correspond to the space (area) occupied by the casing 23 with all the pump stages. As such, the largest component radial footprint of the pump assembly 20, including radial footpring FP1 of the power input gear 24, may remain similar, while the axial footprint AFP of the pump assembly 20 is reduced.

The components of the third pump stage 50 are now described, similarly as above for the other pump stages 30, 40.

The pump chamber 51 defines a third flow path 51A. In the depicted embodiment, the flow path 51A extends from a fluid inlet port 21" distinct from that of the flow paths 31A and 41A of the first and second pump stages 30, 40. The flow path 51A extends to a distinct fluid outlet port 22' than that of the first and second pump stages 30, 40. Such flow path interaction(s) may be interchangeable in other embodiments. In the depicted embodiment, the third pump stage 50 includes shafts 52A, 52B mounted to the casing 20A for rotation about respective rotation axes R5, R6, with a pair of intermeshing gears 53A, 53B disposed in the flow path 51A of the third pump chamber 51. The third pair of intermeshing gears 52A, 52B intermeshing each other for joint rotation. The shaft 52A is rotatably supported relative to the casing 20A for rotation about a rotation axis R5 different than the rotation axis R1 of the shaft 32A of the first stage 30. One intermeshing gear 52A of the third pump stage 50 is mounted on the shaft 52A. The other intermeshing gear 52B of the third pump stage 50 is mounted on shaft 52B.

The second transmission 23' drivingly engages the shaft 52A of the third pump stage 50 to the shaft 42A of the second pump stage 40, such that the second pump stage 40 and the third pump stage 50 are operatively engaged to each other via the second transmission 23'. The pump stages 30, 40, 50 may be said to be mounted in mechanical cascade (or in series) with respect to each other via the first and second transmissions 23, 23'. In an embodiment, none of R1, R2, R3, R4, R5 and R6 are coincident or coaxial. They may all be parallel to one another.

In some embodiments, the pump assembly 20 may include a pump stage disposed axially with respect to another pump stage. This will now be described with reference to FIGS. 6-7. The pump assembly 20 has a plurality of pump stages including a plurality of pairs of intermeshing gears, with the pairs of intermeshing gears drivingly engaged to an adjacent one of the pairs of intermeshing gears. In the depicted embodiment, at least three pump stages 30, 40, 60 are radially disposed with respect to each other, with the first and second pump stages 30, 40 drivingly engaged to each other via a first transmission 23, and the second pump stage 40 and third pump stage 60 drivingly engaged to each other via a second transmission 23'. As such, the first, second and third stages 30, 40, 60, by their respective intermeshing gears, are operatively connected in series, via the first and second transmissions 23, 23' interconnecting them. All rotational axes may be parallel as illustrated. In the depicted embodiment, the pump stage 50 of the pump assembly 20 includes a pair of intermeshing rotating components 52A, 52B. A first one of the rotating components 52A of the such pump stage 50 is mounted on the first shaft 32A of the first pump stage 30 such that the first one of the rotating components 52A of such pump stage 50 has a same rotation axis than a rotation axis R1 of a first one of the rotating components 33A of the first pump stage 30. In particular, as shown, the rotation axes R5, R6 of the third pair of intermeshing rotating components 53A, 53B are coaxial with the rotation axes R1, R2 of the first pair of intermeshing rotating components 33A, 33B.

The embodiments described in this document provide non-limiting examples of possible implementations of the present technology. Upon review of the present disclosure, a person of ordinary skill in the art will recognize that changes may be made to the embodiments described herein without departing from the scope of the present technology. For example, the pump architecture described above with reference to various embodiments may be applied to gerotor pump or other types of rotating shaft pumps. Yet further modifications could be implemented by a person of ordinary skill in the art in view of the present disclosure, which modifications would be within the scope of the present technology.

The invention claimed is:

1. A pump assembly for an aircraft engine, comprising:

a casing defining at least a first pump chamber and a second pump chamber;

at least a first and a second pump stages enclosed in the casing, the first pump stage and the second pump stage disposed radially with respect to each other, the at least first and second pump stages including respective pairs of intermeshing rotating components disposed respectively in the first pump chamber and the second pump chamber of the casing, the pairs of rotating components mounted for rotation about respective rotational axes relative to the casing via at least one shaft of the first pump stage and at least one shaft of the second pump stage radially spaced apart with respect to each other in a direction transverse to the respective rotational axes, the pairs of rotating components each including a driving rotating component transmitting torque to a driven rotating component by mutual engagement; and a transmission drivingly engaging the pairs of rotating components of the first and second pump stages by coupling to the at least one shaft of the first pump stage and the at least one shaft of the second pump stage, wherein the at least one shaft of the first pump stage is a drive shaft of the pump assembly and the at least one shaft of the second pump stage is a driven shaft of the pump assembly, the drive shaft receiving, during operation of the pump assembly, workload from a power source external to the pump assembly, the second pump stage receiving the workload from the first pump stage in serial driving engagement with the second pump stage via the transmission.

2. The pump assembly as defined in claim 1, wherein the rotating components of the pair of rotating components of the first pump stage are mounted on respective shafts rotatably mounted to the casing, the rotating components of the pair of rotating components of the first pump stage intermeshing each other for causing fluid displacement during rotation from an inlet port through which the fluid is supplied in the casing to an outlet port through which the fluid is discharged from the casing, in fluid communication with the first pump chamber of the first pump stage.

3. The pump assembly as defined in claim 1, further comprising at least a third pump stage disposed axially with respect to the first pump stage, the third pump stage including another pair of intermeshing rotating components, a first one of the rotating components of the third pump stage mounted on the at least one shaft of the first pump stage such that the first one of the rotating components of the third pump stage has a same rotation axis than a respective one of the rotation axes of a first one of the rotating components of the first pump stage.

4. The pump assembly as defined in claim 1, wherein the first pump stage is a pressure pump stage and the second pump stage is a scavenge pump stage, the pressure pump stage operated to circulate fluid from a first inlet port through which the fluid is supplied in the casing to a first outlet port through which the fluid is discharged from the casing of the pump assembly to a component of the aircraft engine, the scavenge pump stage operated to circulate fluid from a second inlet port through which the fluid is supplied in the casing of the pump assembly, the second inlet port receiving fluid from the component of the aircraft engine, the scavenge pump stage discharging the fluid from the casing through a second outlet port of the pump assembly different than the first outlet port.

5. The pump assembly as defined in claim 1, wherein the transmission includes a plurality of transmission gears, at least one of the plurality of transmission gears mounted on each one of the at least one shaft of the first pump stage and the at least one shaft of the second pump stage.

6. A gear pump assembly comprising:

a housing defining a first pump chamber and at least a second pump chamber, the first and second pump chambers forming respective first and second fluid paths;

a first pump stage including a first pair of intermeshing gears in fluid-structure interaction with the first fluid path and mounted into the first pump chamber for rotation about respective rotation axes via a first shaft and a second shaft mounted to the housing, the first pair of intermeshing gears including a driving gear transmitting torque to a driven gear by mutual engagement;

at least a second pump stage, the first pump stage and the at second pump stage disposed radially with respect to each other, the second pump stage including a second pair of intermeshing gears in fluid-structure interaction with the second fluid path and mounted into the second pump chamber for rotation about respective rotation axes via a third and a fourth shafts mounted to the housing, the rotation axes of the first and the second pair of intermeshing gears radially spaced apart with respect to each other, the second pair of intermeshing gears including a driving gear transmitting torque to a driven gear by mutual engagement;

a transmission drivingly engaging one of the first and second shafts to one of the third and fourth shafts, and a power input gear mounted on one of the first shaft and the second shaft, the power input gear operatively engageable to a power source to transmit torque to the first pump stage, the second pump stage mounted in mechanical cascade with the first pump stage, the second pump stage receiving the torque via the first pump stage in serial driving engagement with the second pump stage.

7. The gear pump assembly as defined in claim 6, wherein the housing defines a third pump chamber forming a third fluid path, the gear pump assembly further comprising a third pump stage including a third pair of intermeshing gears in fluid-structure interaction with the third fluid path and mounted into the third pump chamber for rotation about respective rotation axes.

8. The gear pump assembly as defined in claim 7, wherein the rotation axes of the third pair of intermeshing gears are coaxial with the rotations axes of the first pair of intermeshing gears.

9. The gear pump assembly as defined in claim 6, wherein the transmission includes toothed gears drivingly engaged to each other to transmit torque from one of the first and second shafts to one of the third and fourth shafts.

10. The gear pump assembly as defined in claim 9, wherein one of the toothed gear and the power input gear are both mounted on one of the first shaft and the second shaft.

* * * * *